United States Patent [19]

Getz, Jr.

[11] 4,290,549

[45] Sep. 22, 1981

[54] SELF-DROPPING FLAG FOR MAIL BOXES

[76] Inventor: John Getz, Jr., 2014 Naomi Dr., Brooksville, Fla. 33512

[21] Appl. No.: 67,388

[22] Filed: Aug. 17, 1979

[51] Int. Cl.[3] ..... A47G 29/12

[52] U.S. Cl. ..... 232/35

[58] Field of Search ..... 232/35, 34

[56] References Cited

U.S. PATENT DOCUMENTS

| | | | |
|---|---|---|---|
| 1,925,227 | 9/1933 | Black | 232/35 |
| 1,929,965 | 10/1933 | Black et al. | 232/35 |
| 2,098,242 | 11/1937 | Holmes | 232/35 |
| 3,034,706 | 5/1962 | Wing | 232/35 |
| 3,602,424 | 8/1971 | Raulston | 232/35 |
| 3,623,655 | 11/1971 | Tieszen | 232/35 |
| 3,747,839 | 7/1973 | Morton | 232/35 |
| 3,891,139 | 6/1975 | Redling | 232/35 |

*Primary Examiner*—Roy D. Frazier
*Assistant Examiner*—Peter A. Aschenbrenner

[57] ABSTRACT

A rural delivery mail box, including a flag at its side, and another flag at its rear; both of the flags being pivotable automatically between a displayed, and a stored-away, position, when the mail box door is pivoted open by the mailman.

1 Claim, 4 Drawing Figures

Fig. 1
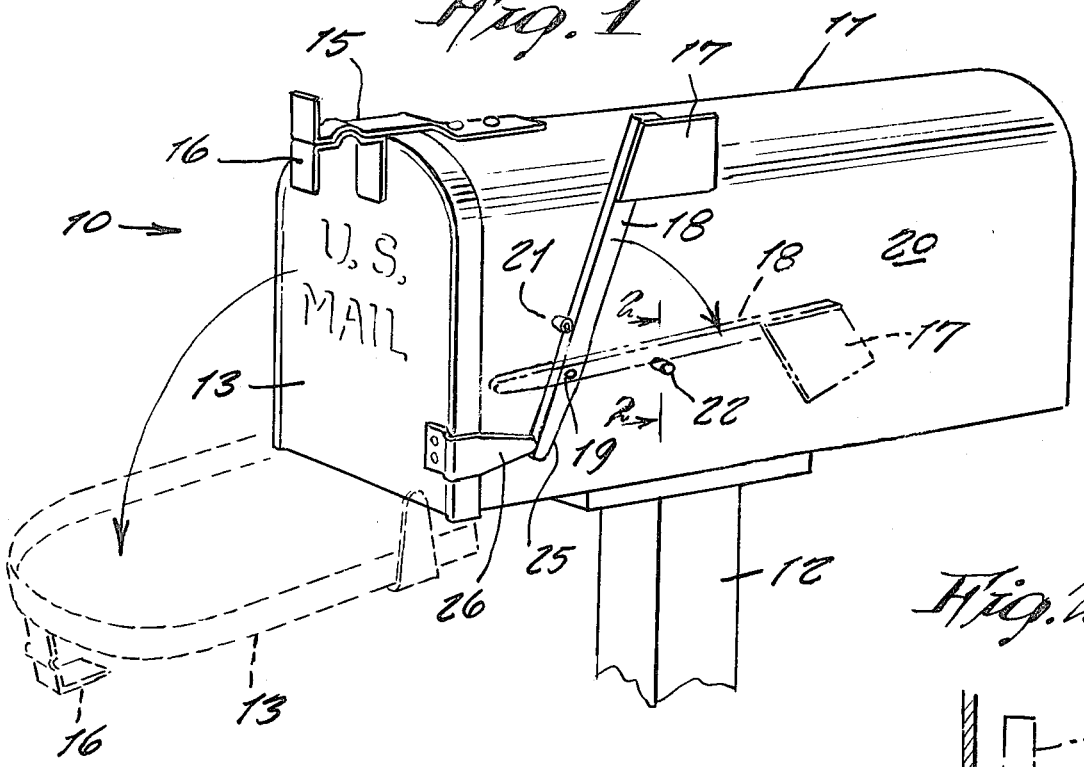
Fig. 2
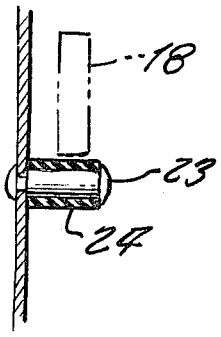
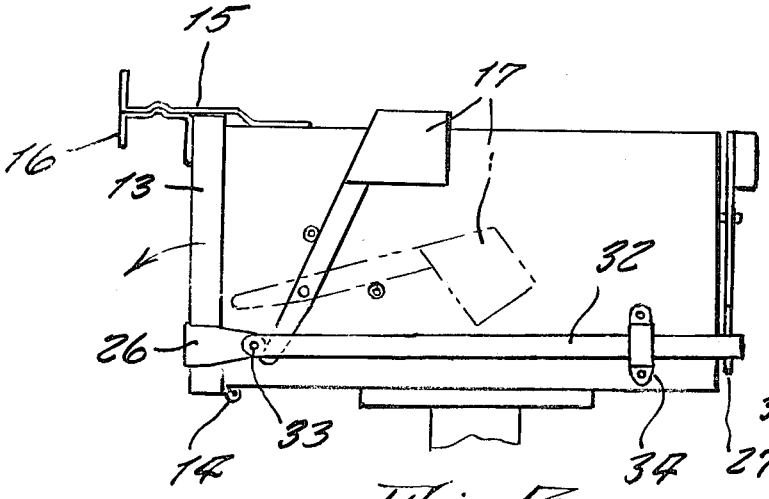
Fig. 3
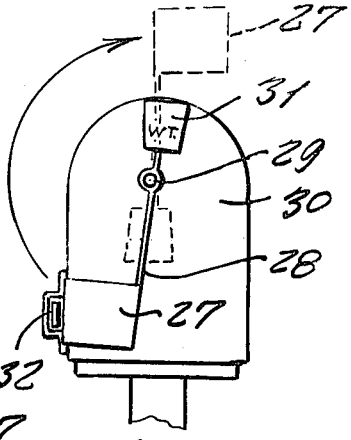
Fig. 4

SELF-DROPPING FLAG FOR MAIL BOXES

This invention relates generally to rural delivery mail boxes, such as are mounted upon a post alongside a country road, so that a mailman, driving by, deposits therein any mail that he has for a farmer, and at the same time, picks up therefrom any mail that the farmer wants to mail out.

It is well known, that such rural mail boxes are provided with a flag at one side, which a farmer raises up whenever he places a letter into the box that he wishes to mail out, the raised flag informing the postman to stop at the mailbox for picking it up, even if he has no mail to leave in the box. After the letter is picked up by the postman, he then lowers the flag into a stored-away position. This flag-lowering action by the postman may take five to ten seconds of time to do, but it adds up to a considerable amount of time, when all the pickups on a route are totalled. It totals a vast amount of time, when all such postmen are burdened with the same chore.

It is a principal object of the present invention to provide a rural mail box, wherein the flag for halting a postman is automatically returned back to a storage position, when the postman opens the mailbox door, thus saving the time and effort of the postman's doing so manually.

Another object is to provide a rural mail box, having yet a second flag, which is located on the rear of the box, and which serves to notify a resident if a mailman has stopped at his box, the second flag being likewise automatically activated, when the mailbox door is opened.

Other objects are to provide a mail box with a pair of flags, and which is simple in design, inexpensive to manufacture, rugged in construction, easy to use, and efficient in operation.

These, and other objects, will be readily evident, upon a study of the following specification, and the accompanying drawing, wherein:

FIG. 1 is a perspective view of the invention, shown in set position, and illustrating, in dotted lines, the device in released position;

FIG. 2 is an enlarged cross-sectional view, taken on line 2—2 of FIG. 1;

FIG. 3 is a side view of the invention, shown including a mechanism which raises a flag at the rear of the box, showing that the mailman has already stopped at the mailbox, and which works independently of the other flag, so that it can be used whether or not a resident has raised the first flag, and is ideal when a resident has no mail to be picked up by the mailman, and FIG. 4 is a rear view of the mechanism that raises the flag at the box rear.

Referring now to the drawing in greater detail, the reference numeral 10 represents an improved mailbox, according to the present invention, wherein there is an elongated box 11, mountable upon a roadside post 12, the box having a front opening closeable by a door 13, pivotable about a hinge 14. A conventional latch 15 holds the door closed, the latch including a handle 16, attached to the door, for being easily pulled by a postman in a vehicle stopped at the mailbox.

In the present invention, a first flag 17 is secured to a bar 18, pivotable about a rivet 19, secured to a sidewall 20 of the box. The pivotable travel of the bar is limited between the stops 21 and 22, mounted on the box sidewall, each of the stops comprising a rivet 23, sheathed by a rubber sleeve 24, against which the bar strikes.

A protruding end 25 of the bar extends beyond the pivot rivet 19, so as to be abutted by an L-shaped plate 26, affixed to the door, and which serves to hold the flag in an upwardly raised position, with the bar abutting stop 21 when the door 13 is closed, such as, before a postman opens the door so as to pick up letters left in the box for the postman. When the door is pivoted open, the plate 26 clears the flag bar, allowing the flag to fall into stored-away position, with the bar falling upon the stop 22, as shown by the phantom lines in FIG. 1.

In a modified design of the invention, shown in FIGS. 3 and 4, a second flag 27, at the rear of the box, serves as a signal to a resident only, and not to a postman. The flag is on a bar 28, pivotable about a rivet 29, secured to the box rear wall 30. An extending end of the bar 28 has a weight 31 affixed thereto.

In a cocked position, prior to arrival of a postman at the mailbox, the flag 27 is in a downwardly pivoted position, as shown by solid lines in FIGS. 3 and 4, and is held in this position by means of the flag abutting against a side of a bar 32, pivotally attached, at one end, by means of a rivet 33, on an end of the L-shaped plate 26.

Thus, when the door is opened, the bar 32 slides forwardly in a guide bracket 34, mounted on the sidewall 20, and the rear end of the bar 32 clears out of the way of the flag 27, so that the weight 31 causes the bar 28 to rotate, as the weight swings downward, and the flag swings upward, so as to be viewed by a resident, possibly inside a house, some distance away from the mail box, as shown by the phantom lines in FIG. 4.

The self-dropping flag on a mail box can be used on other-shaped mail boxes, by slightly altering the design of the part mounted on the door.

While various changes may be made in the detail construction, it is understood that such changes will be within the spirit and scope of the present invention, as is defined by the appended claims.

What I now claim is:

1. An improved mail box, comprising, in combination, an elongated box, an opening at a front of said box, a door pivoted to said box closing said opening, a first flag on a side of said box for signalling a resident; said first flag in a cocked position being raised upwardly for display, and a second flag in a cocked position being in a downwardly lowered, stored position, and said door tripping both said cocked positions when said door is pivoted open; an L-shaped plate, secured to said door, holding a flagstaff of said first flag from pivoting, and a sliding bar, attached to said plate, abutting against said second flag, retaining a flagstaff thereof from pivoting about a rivet secured to a rear wall of said box and extending through an intermediate portion of said flagstaff while an upward extending end of said flagstaff has a weight affixed thereto for being gravity activated for pivoting said flagstaff.

* * * * *